US007981272B2

(12) United States Patent
Dziabis et al.

(10) Patent No.: US 7,981,272 B2
(45) Date of Patent: Jul. 19, 2011

(54) PROCESS FOR REFORMING A HYDROCARBON STREAM IN A UNIT HAVING FIXED AND MOVING BED REACTION ZONES

(75) Inventors: Gary A. Dziabis, Oxshott (GB); Leon Yuan, Rockville, MD (US); David J. Fecteau, Prospect Heights, IL (US)

(73) Assignee: UOP LLC, Des Plaines, IL (US)

( * ) Notice: Subject to any disclaimer, the term of this patent is extended or adjusted under 35 U.S.C. 154(b) by 291 days.

(21) Appl. No.: 11/851,433

(22) Filed: Sep. 7, 2007

(65) Prior Publication Data

US 2008/0156695 A1 Jul. 3, 2008

Related U.S. Application Data

(60) Provisional application No. 60/882,356, filed on Dec. 28, 2006.

(51) Int. Cl.
*C10G 59/02* (2006.01)
*C10G 35/04* (2006.01)

(52) U.S. Cl. ..... 208/64; 208/63; 208/65; 208/99

(58) Field of Classification Search ..... 208/63, 208/64, 65, 99, 134

See application file for complete search history.

(56) References Cited

U.S. PATENT DOCUMENTS

| | | | | |
|---|---|---|---|---|
| 3,864,240 | A | 2/1975 | Stone | |
| 4,455,279 | A | 6/1984 | Garvert | |
| 4,732,665 | A * | 3/1988 | Bennett et al. | 208/134 |
| 4,832,821 | A | 5/1989 | Swan, III | |
| 5,190,638 | A | 3/1993 | Swan, III et al. | |
| 5,190,639 | A | 3/1993 | Swart et al. | |
| 5,196,110 | A | 3/1993 | Swart et al. | |
| 5,211,838 | A | 5/1993 | Staubs et al. | |
| 5,221,463 | A | 6/1993 | Kamienski et al. | |
| 5,354,451 | A | 10/1994 | Goldstein et al. | |
| 5,417,843 | A | 5/1995 | Swart et al. | |
| 5,885,439 | A | 3/1999 | Glover | |
| 5,935,415 | A | 8/1999 | Haizmann et al. | |
| 6,409,910 | B1 | 6/2002 | Nedez | |
| 6,458,266 | B1 | 10/2002 | Lin et al. | |
| 6,790,802 | B1 * | 9/2004 | Sechrist | 502/37 |
| 2004/0129605 | A1 | 7/2004 | Goldstein et al. | |

OTHER PUBLICATIONS

Robert A. Meyers, Part 4 Catalytic Reforming, Handbook of Petroleum Refining Processes, pp. 4.1-4.26, Volume Second Edition, Publisher: McGraw-Hill, Published in: U.S.

* cited by examiner

*Primary Examiner* — Walter D Griffin
*Assistant Examiner* — Renee Robinson
(74) *Attorney, Agent, or Firm* — Maryann Maas

(57) ABSTRACT

A process for reforming a hydrocarbon stream in a reforming unit can include passing a gas including a halogen-containing material from a product separation zone through an adsorption zone to remove at least some of the halogen-containing material before the gas enters a first reforming stage having at least one fixed bed reaction zone.

17 Claims, 3 Drawing Sheets

PROCESS FOR REFORMING A HYDROCARBON STREAM IN A UNIT HAVING FIXED AND MOVING BED REACTION ZONES

CROSS-REFERENCE TO RELATED APPLICATIONS

This application claims the benefit of U.S. Provisional Application No. 60/882,356 filed Dec. 28, 2006, which is hereby incorporated by reference in its entirety.

FIELD OF THE INVENTION

The field of this invention generally relates to a reforming process, such as a catalytic reforming process, having at least one fixed reaction zone and at least one moving bed reaction zone.

BACKGROUND OF THE INVENTION

Generally, one well-known hydrocarbon conversion process is a catalytic reforming process. Catalytic reforming is typically employed in the petroleum refining industry for improving the octane quality of hydrocarbon feedstocks, the primary product of reforming being a motor gasoline blending component or a source of aromatics for petrochemicals.

One exemplary reforming process is a "hybrid" reforming process. Such a hybrid reforming process generally includes at least one fixed reaction zone and at least one moving bed reaction zone. Generally, such units are created during the retrofit of, e.g., a fixed bed reaction process, by adding a moving bed reactor and accompanying regeneration vessel. Typically, the halogen content of the moving bed catalyst reaction zone is controlled by adding a halogen-containing material, such as a chloride, during catalyst regeneration. As such, the moving bed catalyst generally does not become depleted in chloride.

However, the moving bed reaction zone can be a source of hydrogen chloride for the gas recycled to the fixed bed reaction zone. Generally, the fixed bed catalyst and the moving bed catalyst have different chloride retention properties. As a result, the typical operating conditions of a hybrid reforming unit can result in the transfer of chloride from the recycled gas onto the fixed-bed catalyst. Generally, the amount transferred can be in excess of the amount needed to replace the chloride loss in the product streams from the fixed bed reaction zone, even with no added chloride to the fixed bed reactor zone. An over-chlorided catalyst can result in decreased hydrogen and reformate yield and shortened fixed-bed cycle length. As a result, the fixed bed reaction zone can have an undesirable accumulated level of chloride than is desired for optimal performance.

Moreover, imbalance in the catalyst chloride level between the fixed bed catalyst being too high and the moving bed catalyst being at or below the target chloride content can be worsened if any of the following happens:

- Surface area of the fixed-bed catalyst is higher than the surface area of the moving bed catalyst due to the higher regeneration frequency of the recirculating catalyst;
- The weighted average bed temperature (WABT) of the fixed bed catalyst is operated at a lower WABT then the moving bed catalyst at the start of production to extend the fixed bed catalyst cycle length; and
- The fixed-bed catalyst has better chloride retention properties than the moving bed catalyst due to the inherent property differences of the finished catalyst, due to, e.g., the alumina carrier and the manufacturing method.

Typical hybrid systems have shortcomings in failing to control, independently, the halide, such as chloride, content of the fixed-bed catalyst and the moving bed catalyst. Generally, hybrid systems fail to provide any control for the chloride content of the fixed bed catalyst. Consequently, current hybrid reforming systems fail to provide an independent control of the chloride levels in the fixed-bed reaction zone and the moving bed reaction zone.

BRIEF SUMMARY OF THE INVENTION

One exemplary process for reforming a hydrocarbon stream in a reforming unit can include passing the hydrocarbon stream through a first reforming stage, passing the hydrocarbon stream through a second reforming stage, sending the hydrocarbon stream to a separator, separating a gas including a halogen-containing compound, sending at least a portion of the gas to an adsorption zone to reduce an amount of the halogen-containing compound in the gas, and recycling the gas within the reforming unit. Generally, the first reforming stage includes at least one fixed bed reaction zone and the second reforming stage includes at least one moving bed reaction zone.

Another exemplary process for reforming a hydrocarbon stream in a reforming unit can include passing a gas including a halogen-containing material from a product separation zone through an adsorption zone to remove at least some of the halogen-containing material before the gas may enter at least one of a first reforming stage that may have at least one fixed bed reaction zone.

Still yet another exemplary process for controlling chloride retention of at least one catalyst of at least one fixed bed reaction zone of a hybrid reforming unit including at least one fixed bed reaction zone and at least one moving bed reaction zone. The process can include injecting a halide agent into a hydrocarbon stream before passing through the at least one moving bed reaction zone at a concentration of about 0.05-about 50 ppm by weight based on the total weight of hydrocarbons in the hydrocarbon stream. Alternatively, the process can include selecting a fixed bed catalyst and a moving bed catalyst where:

i) an initial surface area of the fixed bed catalyst is less than an initial surface area of the moving bed catalyst; or iii) an initial halide loading of the fixed bed catalyst is greater than an initial halide loading of the moving bed catalyst.

The selected catalyst can be effective to minimize a loading of one or more halides to the fixed bed catalyst from the moving bed catalyst.

The present embodiments can provide one or more mechanisms for allowing independent control of the halide, such as chloride, content in the fixed bed reaction zone of the first stage and the moving bed reaction zone in the second stage. As a result, the ability to separately control the halide, such as chloride, levels in each reaction zone can optimize the performance of a hybrid reforming unit. As a result, both zones can operate at an optimum chloride level for each of their operating parameters.

DEFINITIONS

Figure 1:
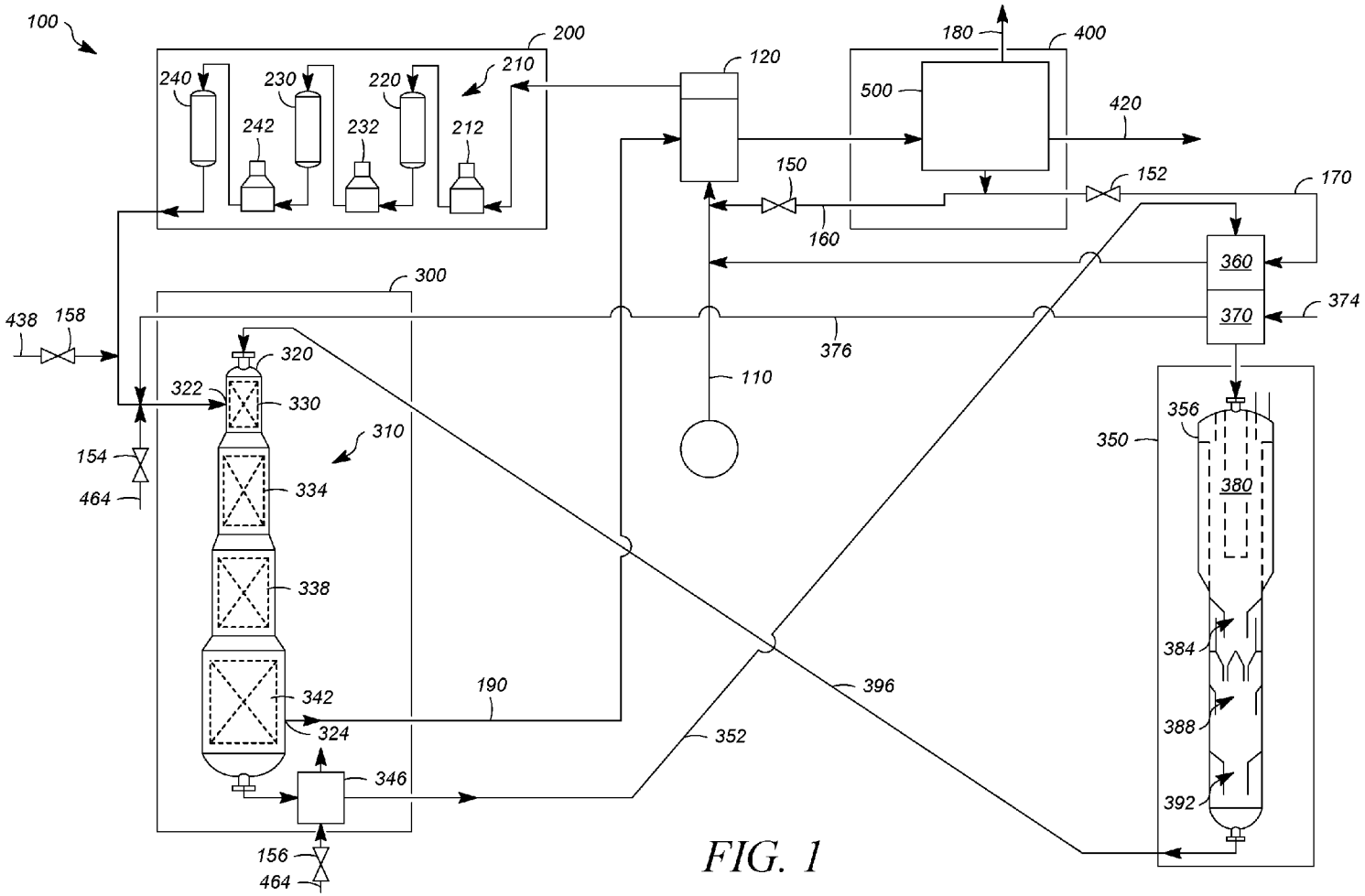
FIG. 1 is a schematic depiction of an exemplary hybrid reforming unit that can include at least one fixed bed reaction zone and at least one moving bed reaction zone.

As used herein, the term "hydrocarbon stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals. The hydrocarbon stream may be subject to reactions, e.g., reforming reactions, but still may be referred to as a hydrocarbon stream, as long as at least some hydrocarbons are present in the stream after the reaction. Thus, the hydrocarbon stream may include streams that are subjected to, e.g., a hydrocarbon stream effluent, or not subjected to, e.g., a naphtha feed, one or more reactions. As used herein, a hydrocarbon stream can also include a raw hydrocarbon feedstock, a hydrocarbon feedstock, a feed, a feed stream, a combined feed stream or an effluent. Moreover, the hydrocarbon molecules may be abbreviated $C_1$, $C_2$, $C_3$ . . . $C_n$ where "n" represents the number of carbon atoms in the hydrocarbon molecule.

As used herein, the term "hybrid reforming unit" can refer to a reforming unit having two stages, where the first stage generally includes at least one fixed bed reaction zone, and a second stage that generally includes at least one moving bed reaction zone. Typically, the gas separated from the product of the second reforming stage is recycled to the feed to the first reforming stage.

As used herein, the term "stage" can refer to at least one fixed bed reaction zone or at least one moving bed reaction zone. Generally, the term "stage" merely refers to a type of reaction zone, namely a fixed or moving bed reaction zone.

As used herein, the term "zone" can refer to an area including one or more equipment items and/or one or more sub-zones. Additionally, an equipment item, such as a reactor or vessel, can further include one or more zones or sub-zones.

As used herein, the term "halogen-containing material" can include a halogen, such as chlorine or fluorine, and a compound containing one or more halogen radicals.

As used herein, the term "halide agent" can include a halogen compound or a compound having one or more halogen radicals. As discussed herein, a preferred "halide" or "halide agent" is, respectively, a "chloride" or "chloride agent" and it should be understood that when a "chloride" or "chloride agent" is referenced, one or more other suitable halides may be used instead. Thus, the specification should not be strictly construed to be limited to "chloride" or "chloride agent" when so referenced.

As used herein, the term "adsorption" can refer to the retention of a material in a bed containing an adsorbent by any chemical or physical interaction between a material, such as a halogen-containing material, and the bed, and includes, but is not limited to, adsorption and/or absorption. The removal of the material from an adsorbent is referred to herein as "desorption."

As used herein, the term "adsorption zone" can refer to a zone where adsorption occurs, and can include an elutriation zone.

DETAILED DESCRIPTION OF THE INVENTION

Although the discussion herein primarily refers to a chloride or chlorides, it should be understood that such compounds can be substituted with other halogen or halogen-containing materials, as appropriate.

Generally, the embodiments herein can provide mechanisms for independently controlling the halogen level, such as the chloride level, in the fixed bed of a hybrid reforming unit. As discussed in further detail hereinafter, these mechanisms can include:

- providing an adsorption zone to adsorb excess halide;
- providing a zone, such as an elutriation zone, to adsorb excess halide;
- injecting a halide at the entrance of the moving bed reactor;
- utilizing a fixed bed catalyst with a greater initial halide loading than a moving bed catalyst; and
- utilizing a fixed bed catalyst with a lesser surface area than a moving bed catalyst.

As discussed hereinafter in reference to the drawing figures, several of these mechanisms are depicted in a single reforming unit to conserve drawing figures. However, it should be understood that a reforming unit can include only one of these mechanisms, or can include two or more in combination.

Moreover, hybrid reforming units including a reforming reaction zone, which can have at least one fixed bed reactor and one moving bed reactor, and a catalyst regeneration zone are disclosed in U.S. Pat. No. 3,864,240 (Stone), U.S. Pat. No. 5,190,639 (Swart et al), and U.S. Pat. No. 5,354,451 (Goldstein et al). So, equipment known in the context of these units is described schematically in the context of the present embodiments for focusing the discussion on the preferred embodiments. Also, any examples discussed herein are prophetic.

Referring to FIG. 1, an exemplary reforming unit or a hybrid reforming unit 100 is depicted. The reforming or hybrid reforming unit 100 can include a combined feed/fluid heat exchanger 120, a first reforming stage 200, a second reforming stage 300, a catalyst regeneration zone or regeneration zone 350, and a product separation zone 400.

The first reforming stage 200 can include at least one fixed bed reaction zone 210. Desirably, the at least one fixed bed reaction zone 210 can include at least one fixed bed reactor, and preferably a first fixed bed reactor 220, a second fixed bed reactor 230, and a third fixed bed reactor 240. Additionally, the first reforming stage 200 may also include at least one heater, and preferably a first heater 212, a second heater 232, and a third heater 242, which can be positioned before respective fixed bed reactors 220, 230, and 240. Exemplary fixed bed reactors for hydrocarbon conversion processes, such as reforming, are known to those skilled in the art and are disclosed in U.S. Pub. No. 2004/0129605 A1 (Goldstein et al) and U.S. Pat. No. 3,864,240 (Stone). Generally, the fixed bed reactors are operated at a temperature of about 370° C. (700° F.)-about 565° C. (1,050° F.). Additionally, typically the reactors 220, 230 and 240 operate at a pressure of about 345 kpa(g) (50 psig)-about 6,895 kpa(g) (1,000 psig), and have a space velocity of about 0.2-about 10 $hr^{-1}$.

The second reforming stage 300 can include at least one moving bed reaction zone 310. The at least one moving bed reaction zone 310 can include a moving bed reactor 320, having an inlet 322 and an outlet 324. In addition, the moving bed reactor 320 can include at least one reaction zone, such as a first reaction zone 330, a second reaction zone 334, a third reaction zone 338, and a fourth reaction zone 342. In addition, the second reforming stage 300 may also include a catalyst collector 346. In some preferred embodiments, the catalyst collector 346 can be integrated with the moving bed reactor. Although not depicted, it should be understood heaters may be present before each of the respective reaction zones 330, 334, 338 and 342. In addition, although the moving bed reactor 320 contains four reaction zones, it should be understood that the moving bed reactor 320 can include any number of zones, and each reaction zone 330, 334, 338 and 342 could be included within separate reactors. Moving bed reactors are known to those of skill in the art and exemplary moving bed reactors are disclosed in U.S. Pat. No. 4,119,526 (Peters et al.) and U.S. Pat. No. 4,409,095 (Peters). Generally, all the reaction zones can operate at a temperature of about 482-about 560° C. (about 900-about 1,040° F.), preferably about 493-about 549° C. (about 919-about 1,020° F.). Additionally, the reaction zones 330, 334, 338 and 342 can operate at a general pressure of about 0 kpa(g)-about 6895 kpa(g) (about 0-about 1,000 psig), preferably about 276 kpa(g)-about 1379 kpa(g) (about 40 psig-about 200 psig). Moreover, the moving bed reactor 320 can have a liquid hourly space velocity of about 0.1-about 50 $hr^{-1}$.

The catalyst regeneration zone 350 can include a regeneration vessel 356, which in turn generally includes a combustion zone 380, a halogenation zone 384, a drying zone 388 and a cooling zone 392. The regeneration zone 350 receives spent catalyst through a lift conduit 352 for regeneration. Such a regeneration vessel 356 is known to those skilled in the art and exemplary regeneration vessels include those disclosed in U.S. Pat. No. 3,652,231 (Greenwood et al.), U.S. Pat. No. 3,647,680 (Greenwood et al.), and U.S. Pat. No. 5,837,636 (Sechrist et al.). Although a regeneration vessel 356 is depicted, it should be understood that any suitable regeneration vessel may be used.

In operation, a hydrocarbon stream, which may be a feed, can travel in a line 110 to the combined feed/fluid heat exchanger 120 before entering the first reforming stage 200. After undergoing some reforming reactions, generally the hydrocarbon stream exits the first reforming stage 200 and enters the second reforming stage 300. Once completed, the reformate can pass through a reactor product line 190 to the combined feed/fluid heat exchanger 120, and then to the product separation zone 400, which will be described in more detail hereinafter. After exiting the zone 400, usually a reformate product exits through the line 420, while gas can be recycled in a gas recycle line 160. Typically, the gas in recycle line 160, which may be recycled to the feed before entering the first reforming stage 200, has a large proportion of hydrogen. In addition, gas can exit the hybrid reforming unit through a line 180. In addition, catalyst can travel to and from the second reforming stage 300 and the catalyst regeneration zone 350. Generally, spent catalyst exits the moving bed reactor 320 and enters the catalyst collector 346 before traveling in the spent catalyst lift conduit 352 to, optionally, zones such as an adsorption, e.g., elutriation, zone 360 and a preheating zone 370. After passing through the preheating zone 370, the catalyst can enter the catalyst regeneration zone 350 and pass successively through the combustion zone 380, the halogenation zone 384, the drying zone 388, and the cooling zone 392 before, typically, being sent back to the moving bed reactor 320 in a lift conduit 396.

Figure 2:
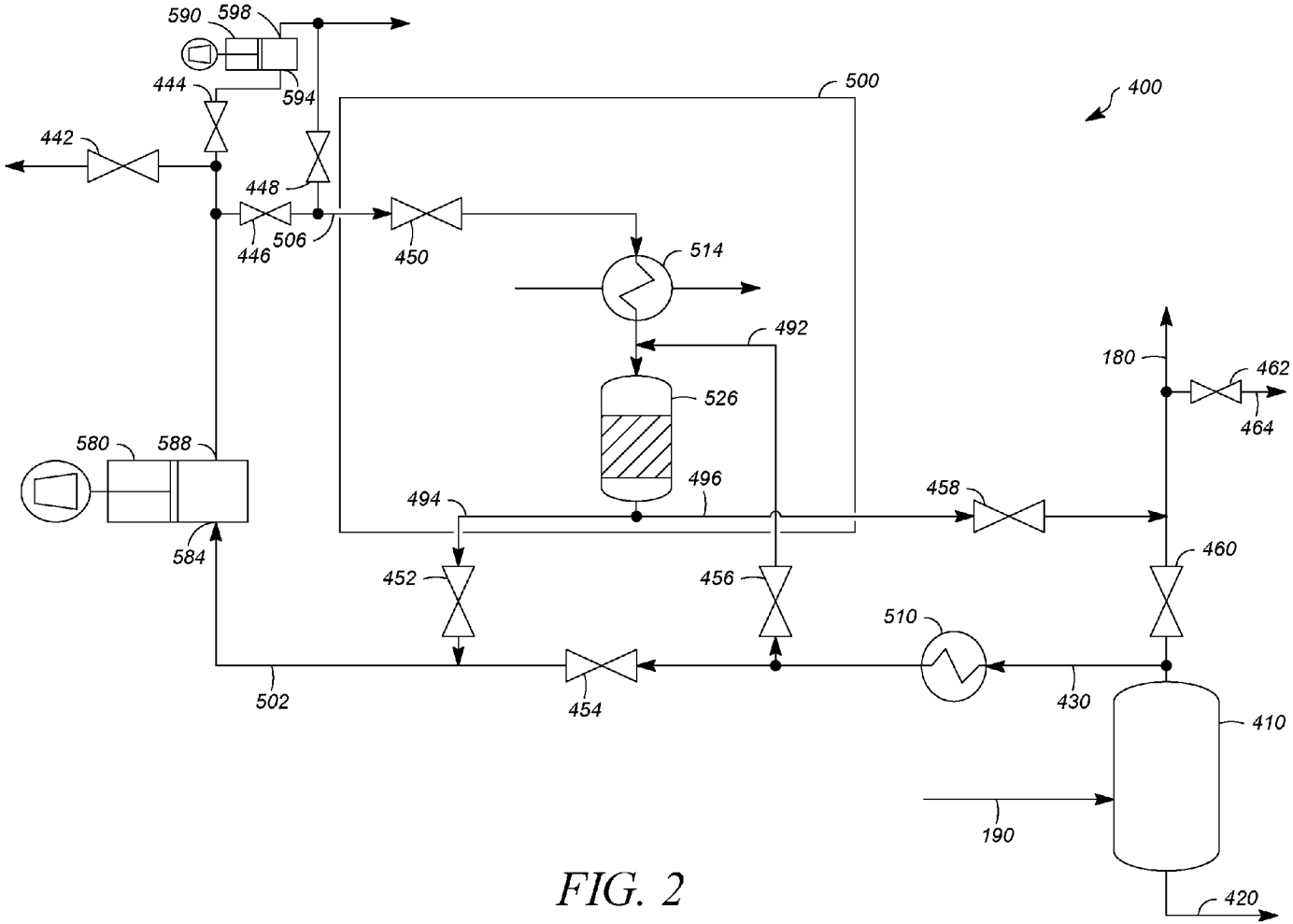
FIG. 2 is a schematic depiction of an exemplary product separation zone, including an adsorption zone.

Referring to FIG. 2, a product separation zone 400 can include a separator 410, an adsorption zone 500, a recycle compressor 580 and a net gas compressor 590. Generally, the product separator 410 receives the product from the second reforming stage 300 in a reactor product line 190. In the separator 410, the reformate can be separated from a gas fraction containing a halogen-containing material, such as hydrogen chloride and hydrogen. This gas fraction can be referred to as a net gas or a vent gas. The reformate can exit through the reformate line 420. In an alternative embodiment, the recycle compressor 580 can be associated with the product separator 410 with the line 180 connected as the suction to the compressor 580.

Generally, the adsorption zone 500 operates in two modes, namely adsorption and desorption. During adsorption, the gas, which may contain hydrogen chloride and hydrogen, can be sent to the adsorption zone 500. The gas, which may be typically at the temperature of the separator 410, can travel through a line 430, and optionally be heated in a heat exchanger 510, desirably a first heat exchanger 510, to heat the gas prior to entering the adsorption zone 500. The heat exchanger 510 can use any suitable heat source, such as steam or a process stream, and may provide a mechanism for controlling the temperature of the vent gas stream. Hence, the rate of adsorption of various components in the vent gas stream, such as a halide and water, can be controlled. In an alternative embodiment, the heat exchanger 510 can be downstream of a valve 456, described hereinafter. The gas may then enter the adsorption zone 500.

During adsorption, generally the gas travels through the line 430, a valve 456 (with a valve 454 closed), a line 492, into an adsorber or a first adsorber 526 having a bed containing an adsorbent for adsorbing the halogen-containing material, such as hydrogen chloride. Alternatively, the valve 454 can be throttled to allow a portion of the vent gas to bypass the adsorption zone 500. Generally, the adsorbent is a molecular sieve, a silica gel, a carbon, an alumina, a spent hydrocarbon conversion catalyst, or a combination thereof.

Typically, the net or vent gas stream that enters the adsorber 526 contains from about 0.5-about 15 mole-ppm hydrogen chloride. The temperature of the gas entering a bed in adsorption mode can be about 66-about 260° C. (about 150-about 500° F.) Only rarely would the adsorption temperatures exceed about 402° C. (about 756° F.) Generally, the temperature is maintained above the dew point temperature and the capillary condensation temperature of the vent gas.

The gas can exit the adsorber 526 via a line 494 before exiting the zone 500 through a valve 452. Generally, the gas exits the adsorber 526 at a temperature of about 71-about 218° C. (about 160-about 424° F.) or about 88-about 205° C. (about 190-about 401° F.). The adsorber 526 can adsorb at least about 25 weight percent, at least about 50 weight percent, at least about 90 weight percent, or even at least 99 weight percent of the entering halides, such as chlorides.

Afterwards, the gas can pass through a line 502 (with the valve 454 being closed or alternatively throttled) before entering a suction 584 of the recycle compressor 580. The recycle compressor 580 can be any compressor suitable for compressing the gas for recycling. Generally, the gas then exits through a recycle compressor discharge 588 and through a valve 442 (with a valve 446 closed) to be recycled. Optionally, some of the gas can pass through a valve 444 and through a net gas compressor 590 by entering a suction 594 and exiting a discharge 598 into, as an example, a high pressure hydrogen header, a refinery gas header, or a fuel gas header.

Once the adsorber 526 reaches capacity, the vessel can be regenerated. In some exemplary embodiments, the regeneration gas can be air or an inert gas, such as nitrogen. Preferably, the gas for regenerating can be predominantly hydrogen obtained from the discharge 588 or 598 of respective recycle gas compressor 580 or the net gas compressor 590. If the gas from the recycle gas compressor is utilized, typically the valves 448, 460, 456, and 452 are closed and the valves 446, 450, and 458 are open. Generally, the regeneration gas passes the valve 450 and, optionally, a second heat exchanger 514 to enter the adsorber 526. Usually, the desorption temperature is higher than the adsorption temperature by at least about 66°

C. (about 150° F.). The desorption temperature can be about 260-about 538° C. (about 500-about 1000° F.). Afterwards, the regeneration gas can exit the zone 500 through a line 496 and a valve 458 to a net gas or fuel gas line 180. Optionally, the valve 462 may be opened to allow gas to pass through a regeneration line 464, as discussed hereinafter. The numeral 464 is utilized for several lines in the FIGS. 1-3 to indicate optional sources and destinations for regeneration gases from the different adsorption zones. Although the line 464 is not depicted in its entirety in the drawings, it should be understood that the line 464 can include a header with different possible destinations, as, e.g., depicted in FIG. 1. Moreover, the regeneration gas can be sent, simultaneously, to one or more destinations. Further still, the desorption gases can be separated from the gases exiting the product separator and sent to a different destination.

Alternatively, the regeneration gas can be taken from the discharge 598 of the net gas compressor 590. In this exemplary embodiment, the valves 446, 452, 456, and 460 can be closed and the valves 448, 450, and 458 can be opened. Generally, once the gas passes from the discharge 598 and passes through the valve 448 to a line 506, the gas can then pass through the valve 450 and, optionally, be heated by the heat exchanger 514 and enter the adsorber 526 and can exit the zone 500, as described above. Thus, these embodiments provide a couple of different sources of regeneration gas to regenerate the catalyst in the adsorber 526. A further alternative is the discharge gas originating from the discharge of a compressor for the hybrid refining unit 100, such as the catalyst regeneration zone 350. Although several alternatives are discussed, it should be understood that the regeneration gas can be provided from only one of the compressors.

Figure 3:
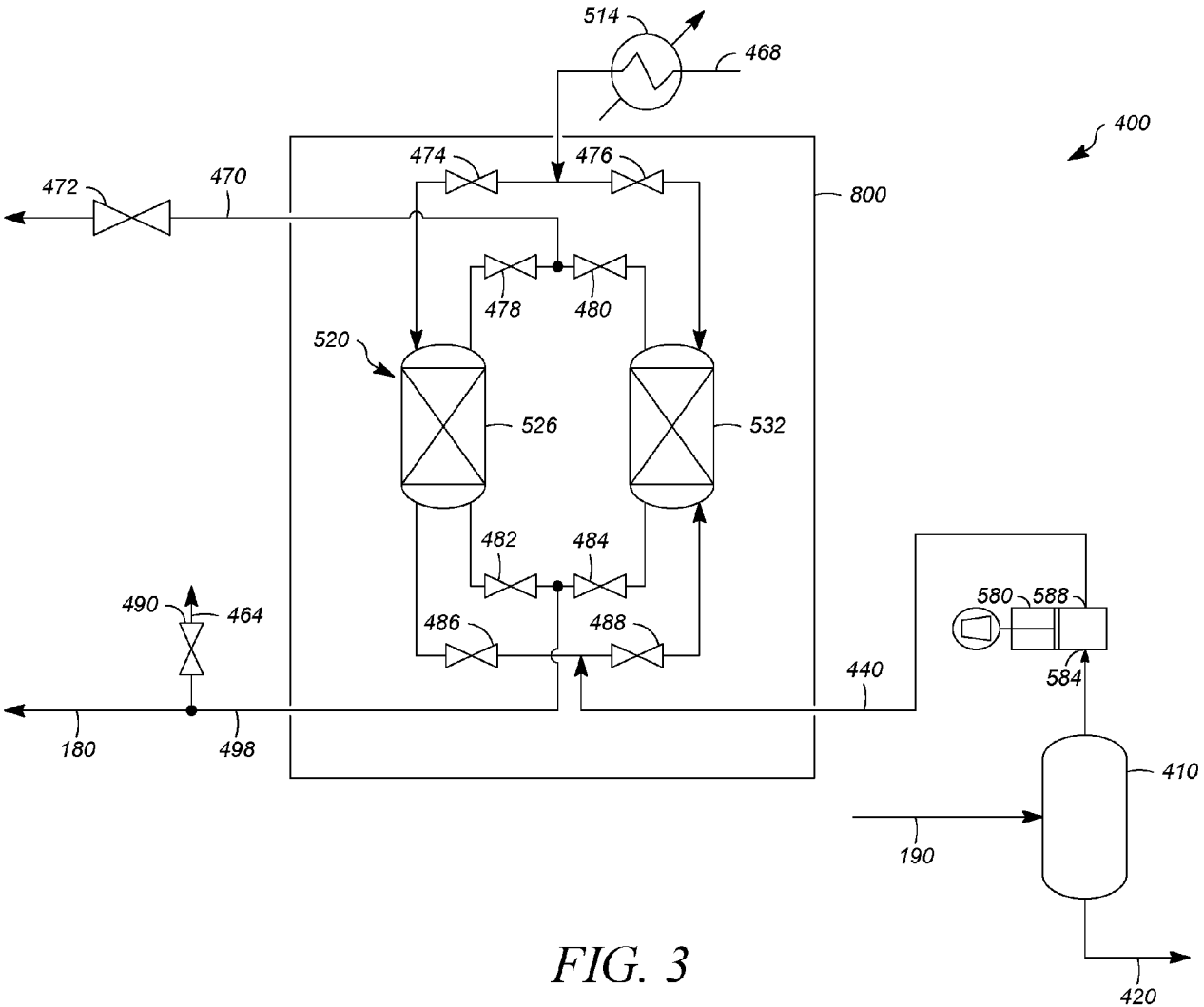
FIG. 3 is a schematic depiction of another exemplary product separation zone, including a further exemplary adsorption zone.

Another exemplary embodiment is depicted in FIG. 3. The product separation zone 400 can include the product separator 410 and a recycled gas compressor 580 as well as a heat exchanger 514 and valves 472 and 490. In this exemplary embodiment, the recycled gas compressor 580 can be upstream of an adsorption zone 800, so the vent gas can be at the temperature of the discharge of the compressor 580. In this embodiment, the adsorption zone 800 can include a plurality of adsorption zones or adsorbers 520 in a parallel configuration, although in other exemplary embodiments the adsorption zones or adsorbers may be in series. Moreover, although two adsorbers are depicted, it should be understood that the zone 800 can include any number of adsorbers. In addition, a heater or an exchanger can be added downstream of the recycled gas compressor 580 and upstream of the adsorption zone 800.

Generally, the adsorption zone 800 includes a plurality of adsorbers 520, namely a first adsorber 526 and a second adsorber 532. Usually, the adsorbers 526 and 532 are swing bed adsorbers, which are known to those of skill in the art and exemplary chloride adsorbers are disclosed in U.S. Pat. No. 6,881,391 (Sechrist) and U.S. Pub. No. 2004/0129605A1 (Goldstein et al). Temperature and other parameters may be similar as discussed above for the adsorption zone 500.

In a typical operation, the vent gas from the separator 410 is discharged by the compressor 580 through a line 440 and through an exchanger before entering the adsorber 532 when a valve 488 is opened and a valve 486 is closed. Afterwards, the gas exiting the adsorber 532 can pass through a valve 480 (with a valve 478 closed) and pass a valve 472 through a line 470 to be recycled or used for some other utilization, such as fuel gas. While the adsorber 532 is adsorbing gasses, a regeneration gas can enter an exchanger 514 through a line 468, and pass a valve 474 (with a valve 476 is closed) and enter the adsorber 526. The regeneration gas can remove the halogen-containing material, such as chlorides, pass through a valve 482 (with a valve 484 closed), and pass through a line 498 to a disposition such as the net gas in the line 180. Alternatively, a valve 490 can be opened to allow at least some of the regeneration gas containing chlorides to be utilized with the second reforming stage 300, as hereinafter described. Typically, once the capacity of the adsorber 532 is reached and the adsorber 526 is desorbed, the adsorber 526 can be placed in adsorption mode and the adsorber 532 can be desorbed. Generally, the amount of halides removed by an adsorption zone does not exceed the halides lost by the second reforming stage 350.

In some exemplary embodiments, gasses from regeneration having halogen-containing material can be utilized at a couple of different points in the hybrid reforming unit 100. Referring to FIG. 1, a portion of regeneration gas can be directed to the catalyst collector 346 at an outlet of the reactor 320 by opening a valve 156. Thus, the gas can pass through the line 464 and the valve 156 into the catalyst collector 346 to have the halogen-containing material, such as chlorides, adsorbed on the spent catalyst and then be sent for another utilization, such as a fuel gas. Alternatively, the regeneration gas, if containing, e.g., nitrogen and oxygen and a minimal amount of hydrogen, can be entrained with the catalyst and travel back to the catalyst regeneration zone 350. Another use of the regeneration gas can include sending the gas through the line 464 and a valve 154 into the entrance of the first reaction zone 330 in the reactor 320 of the second reforming stage 300. If this destination is chosen, the regeneration gas used to regenerate the adsorber should contain an inert gas, such as nitrogen, or hydrogen with a minimal amount of oxygen. Thus, if this destination is utilized, desirably the regeneration gas is not air. Thus, the regeneration gasses from either the adsorption zone 500 or 800 can be recycled to either of these destinations.

Another exemplary embodiment can permit the controlled desorption of vent gas components from the adsorber. Vent gas can contain other components besides halides, such as water. Particularly, the temperature of the regeneration gas can be controlled by the heat exchanger 514 to control the components being desorbed from the adsorbent. As an example referring to FIG. 2, controlling the temperature can allow water and chloride to desorb from an adsorbent, such as alumina, at different temperature ranges, thereby controlling the content of the regeneration gas. As an example, controlling the regeneration gas temperature at a first temperature can allow predominantly water to be desorbed, which could be sent to the line 180 for gas exiting the unit. Subsequently changing the temperature can then allow predominantly hydrogen chloride to be desorbed with a corresponding lower amount of water also being desorbed. This gas stream can be sent through the line 464 by opening the valve 462 to be recycled to the catalyst collector 346 or the second stage 300.

Although an adsorption zone to lower a halogen-containing material content in a recycle gas stream to the first reforming stage 200 has been discussed, other mechanisms can also be used. Referring to FIG. 1, the elutriation zone 360 can be utilized to receive a gas stream from the adsorption unit, or alternatively, be used instead of the adsorption zone 500.

As an example, referring to FIG. 2, the adsorption zone 500 can be bypassed by closing the valves 452 and 456 and opening the valve 454. The vent gas from the separator 410 can pass through the first heat exchanger 510 to the compressor 580. The vent gas can subsequently be discharged through the valve 442. Referring to FIG. 1, a valve 150 can be closed and a valve 152 be opened to allow gas to travel through a line 170 into the elutriation zone 360. The elutriation zone 360 can contain spent hydrocarbon conversion catalyst, such as catalyst disclosed in U.S. Pat. No. 6,034,018 (Sechrist et al.) that can adsorb halogen-containing material, such as chlorides, from the gas stream, which can subsequently be combined with the feed in the line 110. The conditions for the elutriation zone and gas stream passing therethrough can be similar to that disclosed in U.S. Pat. No. 6,034,018 (Sechrist et al.).

The catalyst can then pass through the optional preheating zone 370 where a preheating gas, such as an inert gas, e.g., nitrogen, or hydrogen, can be introduced through a line 374 to heat the catalyst to desorb the chlorides. If a gas including hydrogen is utilized, such as gas discharged from the recycle compressor 580 or the net gas compressor 590, a nitrogen bubble can be used to separate the gases of the zones 370 and 350. The gas can subsequently pass through a line 376 and, optionally, be sent to the entrance of the second reforming stage 300. If the desorbing stream is sent to the entrance of the second reforming stage 300, it is preferable that the preheating gas is hydrogen with minimal oxygen content.

Another mechanism for controlling the halide, such as chloride, levels may also be utilized instead of or with the adsorption zone 500 or 800 and the elutriation zone 360. In this exemplary embodiment, a halide, such as a chloride, agent can be injected through a line 438 through a valve 158. Typically, the halide agent injected can depend, in part, on the type of halide on the catalyst in the first reforming stage 200 and/or second reforming stage 300. Desirably, the halide agent is injected prior to the hydrocarbon stream entering the second reforming stage 300. It should be understood that the halide injection can occur anywhere after the first reforming stage 200 and prior to the stream entering the first reaction zone 330 of the second reforming stage 300. The halide agent can include a hexachloroethane, carbon tetrachloride, 1-chlorobutane, 1-chloro-2-methyl propane, 2-chloro-2-methyl propane, tertiary butyl chloride, propylene dichloride, perchloroethylene, hydrogen chloride, or a combination thereof.

Generally, the halide agent provides a concentration of about 0.05-about 50 ppm, preferably about 0.5-about 10 ppm, by weight of a halide content based on the total weight of hydrocarbons in the hydrocarbon stream. Typically, the molar ratio of water to injected halide in the hydrocarbon stream is less than about 1. Usually, the water concentration in the halide agent is less than about 50 ppm, preferably less than about 5 ppm. Generally, the water concentration in the hydrocarbon stream is less than about 50 ppm, preferably less than about 25 ppm. Desirably, the halide agent is a chloride agent.

In this manner, injecting a halide agent at the beginning of the second reforming stage 300 can maintain or increase the moving bed halide loading. As such, the halide loading of the two zones can be optimized. Particularly, injecting the halide agent in the second reforming stage 300 aids to minimize increases in halide loading levels in the catalyst in the first reforming stage 200 once operations commence. Although dependent upon the catalyst, generally the fixed bed catalyst halide loading may be about 0.9-about 1.2 weight percent and the moving bed catalyst halide loading may be about 0.8-about 1.3 weight percent.

As an example, a halide, such as a chloride, content of the fixed bed catalyst can be 1.15% and the moving bed catalyst can be 0.95%, by weight. By injecting the chloride agent in the second reforming stage 300, the first reforming stage 200 catalyst chloride loading may increase absolutely by about 0.20 weight percent, while maintaining or slightly increasing the loading of the catalyst in the second reforming stage 300 (0.95±about 0.05%, by weight). The chloride loading increase at steady-state can be limited absolutely to about 0.15 weight percent and desirably below about 0.1 weight percent in the first reforming stage 200. In other words, the chloride loading of the first reforming stage catalyst can range from 1.15±about 0.2%, by weight, with a steady-state range of 1.15±about 0.15%, or even about 0.1%, by weight. Thus, it can be possible to keep the chloride loading in the first reforming stage 200 in the desirable range.

What is more, injecting the chloride agent before the second reforming stage 300 can lower a weight ratio of $H_2O/Cl_2$ in the second reforming stage 300 while the moving bed catalyst in the second reforming stage 300 may remove chlorides, increasing a weigh ratio of $H_2O/Cl_2$ in the first reforming stage 200. Injecting chloride to the inlet of the moving bed reactor can aid in maintaining a low water to chloride ratio, and can prevent loss of chloride from the moving bed reactor. Although chloride from the recycled gas can be picked up by the fixed bed reactors, generally significantly more time elapses for the fixed bed reactors to build up the high chloride loading due to their large volume. It is believed that the chloride injection is high enough to ensure that the moving bed catalyst will be chlorinated to a somewhat higher chloride loading than the regenerated catalyst. The effluent from the moving bed reactor can have a lower water/chloride ratio because the chloride is removed by the spent catalyst. Generally, spent catalyst has a higher chloride level than the regenerated catalyst based on constant water concentration within the reactor circuit. Although not wanting to be bound by theory, the adsorption of the chloride by the moving bed catalyst can reduce the chloride content in the recycle gas and avoid the significant increase of the chloride loading in the fixed bed reactor at steady-state. Consequently, this mechanism can control the halogen-containing material being adsorbed in the first reforming stage 200 from the recycled gas steam.

Yet another mechanism for controlling the halide content is utilizing fixed bed catalyst and moving bed catalyst having an initial halide loading effective to minimize subsequent halide accumulation on the fixed bed catalyst from the moving bed catalyst. Desirably, the fixed bed catalyst as an initial halide loading of at least about 0.2%, preferably about 0.35%, by weight, greater than the moving bed catalyst. In one such instance, the moving bed catalyst can have an initial chloride content of no more than about 0.8%, by weight, and the fixed bed catalyst can have an initial chloride level of about 1.15%, by weight. Such a moving bed catalyst is sold under the trade designation R-264 by UOP LLC of Des Plaines, Ill. Utilizing a catalyst having an initial content of no more than 0.8% by weight can minimize the increase of chloride loading for the catalyst in the first reforming stage 200, while the second reforming stage 300 may reach equilibrium.

As an example, the chloride loading differences in the stages 200 and 300 can be about 0.35 percent by weight initially. By using a lower chloride loading catalyst in the second reforming stage 300, the chloride loading on the catalyst in the first reforming stage 200 may increase absolutely by about 0.1 percent by weight after the stages 200 and 300 reach equilibrium. Generally, this loading increase for the fixed bed catalyst can be acceptable, and not affect yields significantly.

In a further exemplary embodiment, the chloride loading can be limited by selecting fixed and moving bed catalysts differing in surface area sufficient to minimize halide loading of the fixed bed catalyst. Desirably, the initial surface area of the fixed bed catalyst is desirably about 10 $m^2/g$, more desirably about 20 $m^2/g$ less than the initial surface area of the moving bed catalyst. Preferably, the fixed bed catalyst has an initial halide, desirably chloride, content of not more than about 1.15% by weight, and has a surface area not exceeding about 160 $m^2/g$. Exemplary catalysts are sold under the trade designations R-16, R-20 and low surface area R-86 by UOP LLC of Des Plaines, Ill. As an example, the difference in chloride loading on the fixed bed catalyst between initial loading and the final equilibrium can be controlled to about 1.15±about 0.1%, by weight. An absolute increase of 0.1%, by weight, should not significantly affect yields. Thus, this mechanism can provide yet another exemplary mechanism for controlling the loading of chloride on the catalyst in the first reforming stage 200.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for reforming a hydrocarbon stream in a reforming unit, comprising:

(a) passing the hydrocarbon stream through a first reforming stage, wherein the first reforming stage comprises at least one fixed bed reaction zone;

(b) passing the hydrocarbon stream through a second reforming stage, wherein the second reforming stage comprises at least one moving bed reaction zone;

(c) sending the hydrocarbon stream to a separator;

(d) separating a gas comprising a halogen-containing material;

(e) sending at least a portion of the gas to an adsorption zone to reduce an amount of the halogen-containing material in the gas;

(f) regenerating the adsorption zone wherein the adsorption zone desorbs at a first temperature to primarily desorb a first component and at a second temperature to primarily desorb a second component;

(g) sending at least a portion of a regeneration gas exiting an adsorber to catalyst collected from the at least one moving bed reaction zone; and (h) recycling at least a second portion of the regeneration gas exiting an adsorber within the reforming unit.

2. The process according to claim 1, further comprising compressing the regeneration gas exiting an adsorber before recycling.

3. The process according to claim 2, wherein the adsorption zone is upstream of compressing.

4. The process according to claim 2, wherein the adsorption zone is downstream of compressing.

5. The process according to claim 1, wherein the adsorption zone comprises a plurality of adsorbers.

6. The process according to claim 5, wherein one adsorber is adsorbing a halogen-containing material and the other adsorber is being regenerated.

7. The process according to claim 6, wherein the regeneration gas before entering the other adsorber comprises at least a portion of the recycled gas from a discharge of a recycle or a net gas compressor.

8. The process according to claim 6, wherein the regeneration gas before entering the other adsorber comprises at least a portion of the gas from a discharge of a compressor for the reforming unit.

9. The process according to claim 6, further comprising heating the regeneration gas before regenerating.

10. The process according to claim 1, further comprising bypassing the adsorption zone with at least a portion of the gas.

11. The process according to claim 1, further comprising heating the gas before entering the adsorption zone.

12. The process according to claim 1, wherein the first component is water and the second component is a halogen-containing material and at least a portion of a regeneration gas at the first temperature is combined with a gas exiting the reforming unit and at least a portion of the regeneration gas at the second temperature is utilized in the second reforming stage.

13. A process for reforming a hydrocarbon stream in a reforming unit, comprising:

(a) passing the hydrocarbon stream through a first reforming stage, wherein the first reforming stage comprises at least one fixed bed reaction zone;

(b) passing the hydrocarbon stream through a second reforming stage, wherein the second reforming stage comprises at least one moving bed reaction zone;

(c) sending the hydrocarbon stream to a separator;

(d) separating a gas comprising a halogen-containing material;

(e) sending at least a portion of the gas to an adsorption zone to reduce an amount of the halogen-containing material in the gas;

(f) regenerating the adsorption zone wherein the adsorption zone desorbs at a first temperature to primarily desorb a first component and at a second temperature to primarily desorb a second component;

(g) sending at least a portion of a regeneration gas exiting an adsorber to an inlet of the moving bed reaction zone; and (h) recycling at least a second portion of the regeneration gas exiting an adsorber within the reforming unit.

14. A process for controlling chloride retention of at least one catalyst of at least one fixed bed reaction zone of a hybrid reforming unit comprising at least one fixed bed reaction zone and at least one moving bed reaction zone, comprising:

selecting a fixed bed catalyst and a moving bed catalyst wherein an initial surface area of the fixed bed catalyst is less than an initial surface area of the moving bed catalyst effective to minimize a loading of one or more halides to the fixed bed catalyst from the moving bed catalyst.

15. The process according to claim 14, wherein the process comprises selecting the fixed bed and moving bed catalyst wherein the initial surface area of the fixed bed catalyst is less than the moving bed catalyst by at least about 10 $m^2/g$.

16. A process for controlling chloride retention of at least one catalyst of at least one fixed bed reaction zone of a hybrid reforming unit comprising at least one fixed bed reaction zone and at least one moving bed reaction zone, comprising:

selecting a fixed bed catalyst and a moving bed catalyst wherein an initial halide loading of the fixed bed catalyst is greater than an initial halide loading of the moving bed catalyst effective to minimize a loading of one or more halides to the fixed bed catalyst from the moving bed catalyst.

17. The process according to claim 16, wherein the process comprises selecting the fixed bed and moving bed catalyst wherein the initial chloride loading of the fixed bed catalyst is at least about 0.2 percent by weight greater than the moving bed catalyst.

* * * * *